US008777517B2

(12) United States Patent
Bianchi

(10) Patent No.: US 8,777,517 B2
(45) Date of Patent: Jul. 15, 2014

(54) UNDERSEA PIPE-LAYING

(75) Inventor: Stefano Bianchi, Cernusco sul Naviglio (IT)

(73) Assignee: Saipem S.p.A., San Donato Milanese (IT)

( * ) Notice: Subject to any disclaimer, the term of this patent is extended or adjusted under 35 U.S.C. 154(b) by 437 days.

(21) Appl. No.: 12/530,091

(22) PCT Filed: Mar. 6, 2008

(86) PCT No.: PCT/EP2008/001789

§ 371 (c)(1),
(2), (4) Date: Sep. 23, 2009

(87) PCT Pub. No.: WO2008/107186

PCT Pub. Date: Sep. 12, 2008

(65) Prior Publication Data

US 2010/0080657 A1 Apr. 1, 2010

(30) Foreign Application Priority Data

Mar. 7, 2007 (GB) ..... 0704411.8

(51) Int. Cl.
*F16L 1/12* (2006.01)

(52) U.S. Cl.
USPC ..... 405/170; 405/166

(58) Field of Classification Search
USPC ..... 405/158, 166, 168.4, 169, 170; 414/745.4
See application file for complete search history.

(56) References Cited

U.S. PATENT DOCUMENTS

| | | | | |
|---|---|---|---|---|
| 3,668,878 | A * | 6/1972 | Jones et al. | 405/167 |
| 3,680,322 | A * | 8/1972 | Nolan et al. | 405/166 |
| 3,822,558 | A | 7/1974 | Blankenship | |
| 3,901,043 | A * | 8/1975 | Silvestri et al. | 405/167 |
| 3,967,461 | A | 7/1976 | Rosa et al. | |
| 4,068,490 | A * | 1/1978 | Jegousse | 405/166 |
| 4,257,718 | A | 3/1981 | Rosa et al. | |
| 4,297,054 | A * | 10/1981 | Yenzer et al. | 405/168.3 |
| 4,486,123 | A * | 12/1984 | Koch et al. | 405/169 |
| 5,011,333 | A | 4/1991 | Lanan | |

(Continued)

FOREIGN PATENT DOCUMENTS

| | | |
|---|---|---|
| EP | 0 302 038 A1 | 2/1989 |
| GB | 2 095 787 | 10/1982 |

(Continued)

OTHER PUBLICATIONS

International Search Report and the Written Opinion of the International Search Authority (Forms PCT/ISA/210 and PCT/ISA/237) issued in corresponding International Application No. PCT/EP2008/001788 dated Jun. 17, 2009.

(Continued)

*Primary Examiner* — Tara M. Pinnock
(74) *Attorney, Agent, or Firm* — Buchanan Ingersoll & Rooney PC

(57) ABSTRACT

A monohull vessel for laying a pipeline includes tensioners 13 disposed along a Pipelaying path P. The pipelaying path P includes an upstream portion that is substantially horizontal and at least 10 m above the center of rolling R of the vessel and, towards a stern end of the vessel hull, a downstream portion that is downwardly inclined and, in use, enters the water at a location inboard of the stern end of the vessel hull 1.

35 Claims, 4 Drawing Sheets

(56) References Cited

U.S. PATENT DOCUMENTS

| | | | | |
|---|---|---|---|---|
| 5,044,825 | A | 9/1991 | Kaldenbach | |
| 5,413,434 | A * | 5/1995 | Stenfert et al. | 405/166 |
| 5,421,675 | A * | 6/1995 | Brown et al. | 405/170 |
| 5,464,307 | A * | 11/1995 | Wilkins | 405/166 |
| 5,823,712 | A | 10/1998 | Kalkman et al. | |
| 5,836,719 | A | 11/1998 | Martin et al. | |
| 6,352,388 | B1 * | 3/2002 | Seguin | 405/166 |
| 6,361,250 | B1 * | 3/2002 | de Varax | 405/158 |
| 6,592,297 | B2 * | 7/2003 | Frijns et al. | 405/170 |
| 6,702,519 | B2 * | 3/2004 | Stockstill | 405/168.3 |
| 6,761,505 | B2 * | 7/2004 | Stockstill | 405/166 |
| 6,761,506 | B2 * | 7/2004 | De Lang et al. | 405/168.3 |
| 2003/0219313 | A1 | 11/2003 | Giovannini et al. | |
| 2006/0188341 | A1 | 8/2006 | Stockstill | |

FOREIGN PATENT DOCUMENTS

| | | | |
|---|---|---|---|
| GB | 2 335 722 | | 9/1999 |
| NL | 8802725 | | 6/1990 |
| WO | WO 2004/068012 | A2 | 8/2004 |
| WO | WO 95/25237 | A1 | 9/2005 |
| WO | WO 2007/000609 | A2 | 1/2007 |

OTHER PUBLICATIONS

Scaini et al., U.S. Appl. No. 12/530,083, entitled "Prefabrication of Pipe Strings on Board of Pip-Laying Vessels" filed Sep. 23, 2009.
International Search Report (PCT/ISA/210) for PCT/EP2008/001789 mailed Jul. 30, 2008.
Written Opinion (PCT/ISA/237) for PCT/EP2008/001789 mailed Jul. 30, 2008.
GB Search Report in GB0704411.8 dated Jun. 28, 2007.
GB Search Report in GB0704410.0 dated Jun. 28, 2007.

* cited by examiner

UNDERSEA PIPE-LAYING

TECHNICAL FIELD

This invention relates to a vessel for laying a pipeline at sea and to a method of laying a pipeline. The invention is concerned particularly with the path along which the pipeline is guided by the vessel.

BACKGROUND OF THE INVENTION

When laying a pipeline at sea one of two methods is commonly used: either the "S" laying method or the "J" laying method. The two methods are named in accordance with the general shape adopted by the pipeline during laying. In "S" laying, the pipeline leaves the vessel at little or no inclination to the horizontal, adopts a steeper inclination in the water and then returns to a generally horizontal disposition on the seabed. In "J" laying, the pipeline leaves the vessel at a steep or vertical inclination and the inclination steadily reduces until the pipeline is in a generally horizontal disposition on the seabed. As interest in laying pipeline in deep water has increased, so "J" laying has become more attractive because the pipeline naturally adopts a vertical or near-vertical orientation far from the seabed. "J" laying is not, however, preferred in shallower water where the natural path of the pipeline is only ever inclined at a shallow angle as it passes to the seabed and "S" laying is therefore advantageous.

When designing a vessel it is in principle possible to equip it for both "J" laying and "S" laying and then to choose which laying technique to use in any particular case. That is, however, an unsatisfactory solution because of the size and cost of the equipment required. Another solution that has been proposed is to provide a "J" lay vessel in which the "J" lay tower can be pivoted to any of a variety of angles according to the depth of the water. A problem with that solution is that the same tower has to be able to be operated over a wide range of angles, which, for example, makes it difficult to provide welding stations on the tower.

"S" laying can be employed in deep water provided the pipeline being laid can be supported from the vessel until it has reached a relatively steep inclination to the horizontal. That, however, requires a considerable length of support, because the radius of bending to which the pipeline can be subjected is limited, especially in the case of large diameter pipelines.

One approach to providing an "S" laying vessel includes providing a semisubmersible vessel with twin keels. For example, U.S. Pat. No. 4,257,718 shows such an arrangement. Another approach to providing an "S" laying vessel involves providing a monohull vessel as shown, for example, in U.S. Pat. No. 5,823,712. An advantage of a twin keel semisubmersible vessel is that it can provide a relatively roll-free environment for the pipe laying and also considerable amounts of space to either side of a central pipe laying path on the vessel (also known to those skilled in the art as "the firing line"). The extra breadth of such a vessel and its relatively large draught are, however, disadvantages compared to a monohull vessel.

In order to benefit from having a monohull vessel, it is desirable to keep the dimensions of the vessel as small as possible, while providing the necessary facilities. When laying small diameter pipes it is sometimes preferred to provide a long length of prefabricated pipeline on a reel and to lay the pipeline by unwinding the reel, but especially for large diameter pipelines it is usual to form the pipeline from discrete lengths of pipe each typically about 12 m long. In this case it is desirable to weld individual lengths of pipe into prefabricated pipe lengths (also referred to herein as "jointed pipe sections") consisting of, say, two, three or four individual lengths of pipe and then to weld the prefabricated pipe lengths to the end of the pipeline as it is being laid. Such a procedure enables the speed of laying to be increased over that which would apply if each individual pipe length were welded in turn to the end of the pipeline as it is laid. Thus the vessel is required to accommodate welding stations and other facilities for preparing prefabricated pipe lengths.

A monohull vessel is susceptible to rolling when at sea and, in order to reduce the effect that the rolling action has, it is desirable to have the welding station(s) at which a new prefabricated pipe length is added to the pipeline being laid close to the axis of rolling; the rolling action then causes only a little oscillating movement at the welding stations.

A monohull vessel of this kind is shown in U.S. Pat. No. 5,823,712. The vessel has a horizontal pipelaying path in the region of the rolling axis of the vessel and this path extends substantially the whole length of the vessel and accommodates at the upstream (bow) end the necessary welding stations for welding new prefabricated pipe lengths to the pipeline and at the downstream (stern) end tensioners for tensioning the pipeline between the vessel and the seabed. In order to provide controlled bending of the pipeline away from the horizontal a "tail unit" is provided that projects from the stern of the vessel hull and that is of a length comparable to that of about half the length of the vessel hull. The pipeline therefore leaves the stern of the vessel hull at an angle only gently inclined to the horizontal and the tail unit provides a long extension to the vessel.

The arrangement just described is useful in providing a lay path along which to first weld, then tension and then bend the pipeline but has the disadvantages that the part of the pipeline being laid over the tail unit is exposed (which is a particular problem in icy waters) and that the load applied to the vessel by the pipeline is applied at the end of the tail unit which is much further from the barycentre (centre of gravity) of the vessel than the stern of the vessel hull and can therefore apply large moments (torques) to the vessel.

It is an object of the invention to provide a monohull vessel for laying a pipeline and a method of laying a pipeline which overcomes or mitigates at least some of the disadvantages described above.

SUMMARY OF THE INVENTION

According to a first aspect of the invention there is provided a monohull vessel for laying a pipeline, the vessel including tensioners disposed along a pipelaying path, wherein the pipelaying path includes an upstream portion that is substantially horizontal and at least 10 m above the centre of rolling of the vessel and, towards a first end of the vessel hull, a downstream portion that is downwardly inclined and, in use, enters the water at a location inboard of the first end of the vessel hull.

By taking the unusual step of positioning the upstream portion of the pipelaying path well above the rolling axis of the vessel it becomes possible to provide a monohull vessel which is able to operate in a wide range of water depths whilst giving good protection to the pipeline as it leaves the vessel during laying at what may be a substantial inclination to the horizontal. At the same time, because the pipeline enters the water before it reaches the limits of the vessel hull, the pipeline can be well protected in the region of the surface of the water where it could face a great risk of damage.

In the first aspect of the invention, the substantially horizontal upstream portion of the pipelaying path is preferably at least 20 m above the centre of rolling of the vessel. In embodiments of the invention described below the substantially horizontal upstream portion of the pipelaying path is 20 m to 25 m above the centre of rolling of the vessel.

Preferably the vessel hull includes, on the waterline and in the region of its first end, separate portions on opposite sides of the pipelaying path. By providing portions of the hull on each side of the pipeline as it passes into the water and through the surface region of the water, especially good protection to the pipeline is provided.

The separate portions may define an enclosed moonpool but preferably they define between them a recess that is open at the first end of the vessel hull; that enhances the accessibility of the pipeline in the region where it leaves the vessel. The separate portions also preferably define between them a recess that is open at the bottom; that enables the pipeline to pass to a level below the bottom of the vessel hull before it reaches the first end of the vessel hull. The separate portions may be joined to one another above the waterline.

When a monohull vessel is used to lay pipeline by "S" laying, the pipeline usually leaves the vessel at the stern so that the vessel moves forwards during pipelaying. Accordingly the first end of the vessel hull is preferably at the stern end.

According to an especially advantageous feature of the invention, the pipelaying path begins to curve downwardly upstream of some or all of the tensioners. By introducing curvature to the pipeline early it becomes possible to have the pipeline downwardly inclined at an early stage in its path towards the first end of the vessel hull, thereby enabling the inclination of the pipeline at the first end of the vessel hull to be increased. Thus it is preferred that at least one tensioner is disposed along a portion of the pipelaying path that is inclined downwardly relative to the upstream portion of the pipelaying path, and it is more preferred that all the tensioners are disposed along portions of the pipelaying path that are inclined downwardly relative to the upstream portion of the pipelaying path.

Upstream of the tensioners, the tension in the pipeline is of course much reduced and it may therefore be desirable, in order to cause the pipeline to follow a curved path, to have one or more pressure rollers for bearing against the pipeline. Thus, the vessel preferably includes one or more pressure rollers disposed along the pipelaying path upstream of the tensioners for pressing the pipeline into a curved configuration. Further pressure rollers may also be provided between tensioners to generate the curved configuration and/or to ease the pressure on the tensioners. Where reference is made herein to a "pressure roller" it should be understood that the term is to be understood in a broad sense as covering any roller, ball, caterpillar track or similar arrangement for applying radial pressure to the pipeline.

The present invention is particularly applicable to pipe laying arrangements in which lengths of pipeline are welded in turn to the end of the pipeline as it is laid, rather than to reel pipe laying arrangements. Accordingly, the vessel preferably further includes welding stations disposed along the pipelaying path for welding further lengths of pipeline to a pipeline being laid along the pipelaying path. The vessel also preferably includes prefabricating stations on the vessel for welding individual pipe lengths together to form lengths of pipeline, each comprising a plurality of individual pipe lengths. The prefabricating stations may be arranged to weld together two, three or four individual pipe lengths. As explained below with reference to an illustrated embodiment of the invention, certain preferred features of the invention are particularly selected to suit laying of a pipeline made up by welding pipe lengths of about 36 m to the end of the pipeline. The 36 m pipe lengths may be prefabricated from two lengths each of about 18 m or from three lengths each of about 12 m. The prefabricating stations are preferably located on decks below the level of the upstream portion of the pipelaying path; since the upstream portion of the pipelaying path is more than 10 m above the rolling axis of the vessel, there is space on the vessel below the pipelaying path and some of that space is advantageously used for prefabrication of pipe lengths.

The prefabricating stations may be configured as disclosed in UK patent application GB0704410.0 entitled "Prefabrication of pipe strings on board of pipe-laying vessels", with agent's reference 12739/JGP, filed on 7 Mar. 2007. The contents of that application are fully incorporated herein by reference. The vessel and/or method of the present invention may incorporate any of the features disclosed in the UK patent application. In particular, the claims of the present application may be amended to include any of the features disclosed in that application. For example, the feature of providing pipe processing stations able to produce double-length and triple-length pipe sections may be incorporated in the present invention.

An advantage of the vessel according to the present invention is that it may be used for laying pipeline in both deep and shallow water. When laying pipeline in shallow water the amount of curvature introduced into the pipeline before it leaves the vessel may be deliberately less than the maximum allowed by the vessel design, but when laying pipeline in deep water it will usually be preferred to introduce as much curvature as possible. In a configuration for introducing as much curvature as possible, it is preferred that the pipelaying path enters the water at an angle inclined to the horizontal of more than 20 degrees. The maximum inclination that will be obtainable will depend upon the curvature that the pipeline can tolerate and will generally be greater for a small diameter pipeline than for a large diameter pipeline.

Whilst it is within the scope of the invention for the vessel to provide no guidance of the pipeline once the pipeline is away from the hull of the vessel, it is preferred that the vessel further includes an internal ramp which defines a part of the pipelaying path and which is connected at one, upstream, end to the hull of the vessel. Preferably the downstream end of the internal ramp is located in the region of the first end of the vessel hull, preferably inboard of the first end of the vessel hull. Such arrangements enable further controlled bending of the pipeline to take place along the length of the internal ramp which is still in a region that is protected by the vessel hull. Preferably, at the downstream end of the internal ramp, the pipelaying path is more than 2 m, and more preferably more than 5 m, below the waterline. In this specification, the pipelaying path should be regarded as the central longitudinal axis of the pipeline. The end of the internal ramp is preferably inboard of the first end of the vessel hull and therefore the pipelaying path may be still further below the waterline at the first end of the vessel hull. Preferably the pipelaying path is more than 6 m below the waterline at the first end of the vessel hull.

The internal ramp may be pivotally mounted on the vessel for pivoting movement about a horizontal axis transverse to the longitudinal axis of the vessel. The ramp may then be pivoted to a desired angle according to the inclination required at the downstream end of the ramp. The internal ramp therefore has one extreme working position at which the inclination of the ramp is at a minimum and another extreme working position at which the inclination of the ramp is at a maximum.

The ramp preferably occupies only a relatively short portion of the vessel. Thus the ratio between the length of the horizontal projection of the internal ramp and the length of the hull of the vessel is preferably between 0.05 and 0.20, and in embodiments of the invention described below the ratio is between 0.08 and 0.15. Where the inclination of the ramp is adjustable, these ratios preferably apply when the inclination of the ramp is at a minimum. The curvature of the internal ramp may be adjustable, for example by moving rollers on the ramp in a direction transverse to the pipelaying path.

For some applications the internal ramp will be all that is required to guide the pipeline, but especially for laying in deep water (deep water being defined as a depth of more than 1000 m) it may be desirable to connect an external ramp to the internal ramp to allow the pipeline to be supported until it reaches a steeper inclination. Thus, the vessel may further include an external ramp which defines a part of the pipelaying path and which is connected at an upstream end to the downstream end of the internal ramp. For operation in even deeper water, the vessel may further include a further ramp which defines a part of the pipelaying path and which is connected at one, upstream, end to the downstream end of the external ramp.

Preferably, the substantially horizontal upstream portion of the pipelaying path is substantially straight. Within this straight section welding stations are preferably provided for welding new pipe lengths to the end of the pipeline. The length of the substantially horizontal upstream portion of the pipelaying path can be defined in either of two ways: firstly there is the length that begins one prefabricated pipe length upstream of a first, most upstream, welding station for working on the pipeline—that length is referred to herein as the active length of the substantially horizontal upstream portion of the pipelaying path; secondly there is the length that includes also some further space for additional working—that second length that includes the further upstream space is referred to herein as the extended length of the substantially horizontal upstream portion of the pipelaying path. Preferably the ratio of the extended length of the straight, substantially horizontal, upstream portion of the pipelaying path to the length of the hull of the vessel is between 0.48 and 0.56, and in embodiments of the invention described below the ratio is about 0.52. Preferably the ratio of the active length of the straight, substantially horizontal, upstream portion of the pipelaying path to the length of the hull of the vessel is between 0.4 and 0.5, and in embodiments of the invention described below the ratio is about 0.46. The straight, substantially horizontal, section of the pipelaying path is preferably defined by a straight ramp fixed to the vessel.

The pipelaying path preferably includes a curved portion extending from the straight, substantially horizontal, upstream portion of the pipelaying path to the downstream portion of the pipelaying path. The invention may be applied to laying of a pipeline of any diameter, but it is especially advantageous when employed with relatively large diameter pipeline, including pipeline having a diameter of 60 inches (1.52 m). Such large diameter pipelines cannot be bent sharply without damage and the present invention is able to provide advantageous results even with relatively small bending radii. The radius of curvature of the curved portion is preferably constant, but it may also vary. Preferably the average radius of curvature of the curved portion is in the range of 250 to 400 m, more preferably in the range of 270 to 310 m, and in embodiments of the invention described below the radius is in the range of 300 to 310 m. Preferably, the curved portion extends from the straight, substantially horizontal, upstream portion of the pipelaying path to the region where the pipelaying path leaves the vessel hull (the location where the internal ramp, if provided, is connected to the vessel hull). Preferably, the ratio of the length of the horizontal projection of the curved portion of the pipelaying path to the length of the hull of the vessel is between 0.25 and 0.45, and in embodiments of the invention described below the ratio is between 0.3 and 0.4. The curved portion of the pipelaying path is preferably defined by a curved ramp fixed to the vessel; the ramp will usually be of a fixed curvature.

In conventional monohull vessels for "S" laying, curvature is first introduced into the pipeline close to the stern of the vessel with much of the bending of the pipeline taking place aft of the vessel hull. Preferred embodiments of the present invention enable that initial bending to take place much earlier and close to the centre of the vessel. Thus the junction of the curved portion of the pipelaying path with the straight, substantially horizontal upstream portion of the pipelaying path may be at a horizontal distance d from a vertical plane transverse to the longitudinal axis of the vessel and passing through the barycentre of the vessel, where the ratio of d to the length of the hull of the vessel is less than 0.2, preferably less than 0.1, and in embodiments of the invention described below the ratio is less than 0.05.

In the description of the vessel above, the most preferred form of vessel has been described. This vessel incorporates several features which are not only inventive and advantageous in combination but also inventive and advantageous when used alone or in other combinations.

For example, the feature that the pipelaying path enters the water at a location inboard of the first end of the vessel hull is a feature that can be used advantageously even in a case where the pipelaying path does not have a high horizontal upstream portion. Thus, according to another aspect of the invention, there is provided a monohull vessel for laying a pipeline, wherein the pipelaying path includes an upstream portion that is substantially horizontal and, towards a first end of the vessel hull, a downstream portion that is downwardly inclined and, in use, enters the water at a location inboard of the first end of the vessel hull. Also, according to a further aspect of the invention, there is provided a monohull vessel for laying a pipeline, the vessel including one or more tensioners disposed along a pipelaying path, wherein the pipelaying path defined on the vessel includes, towards a first end of the vessel hull, a downstream portion which enters the water at a location inboard of the first end of the vessel hull.

Similarly, the feature of providing a pipelaying path with tensioners along a curved part of the path is an especially advantageous feature that can be employed in other applications. Accordingly, according to a still further aspect of the invention, there is provided a monohull vessel for laying a pipeline, the vessel including one or more tensioners disposed along a pipelaying path, wherein the pipelaying path includes an upstream straight portion and a curved portion downstream of the straight portion along which the downward inclination of the pipelaying path to the horizontal increases, at least one tensioner being positioned partway along the curved portion.

The present invention still further provides a method of laying a pipeline from a monohull vessel, in which the pipeline is guided along a substantially horizontal path above the level of the centre of rolling of the vessel and is then guided along a curved path and into the sea inboard of the vessel.

The method may employ any of the forms of monohull vessel defined above.

It will be appreciated that the various aspects of the invention as described herein are closely related and that therefore essential or preferred features of one aspect of the invention may be incorporated into other aspects of the invention as described herein. Also, any aspect of the method of the invention may use, or be performed on, a vessel according to any other aspect of the invention. Similarly, the vessel according to any aspect of the invention may be so configured as to be suitable for use in a method according to any other aspect of the invention. Features of the apparatus of the invention may be incorporated into the method of the invention and vice versa.

BRIEF DESCRIPTION OF THE DRAWINGS

By way of example embodiments of the invention will now be described with reference to the accompanying drawings, of which.

DETAILED DESCRIPTION OF EMBODIMENTS

Figure 1:
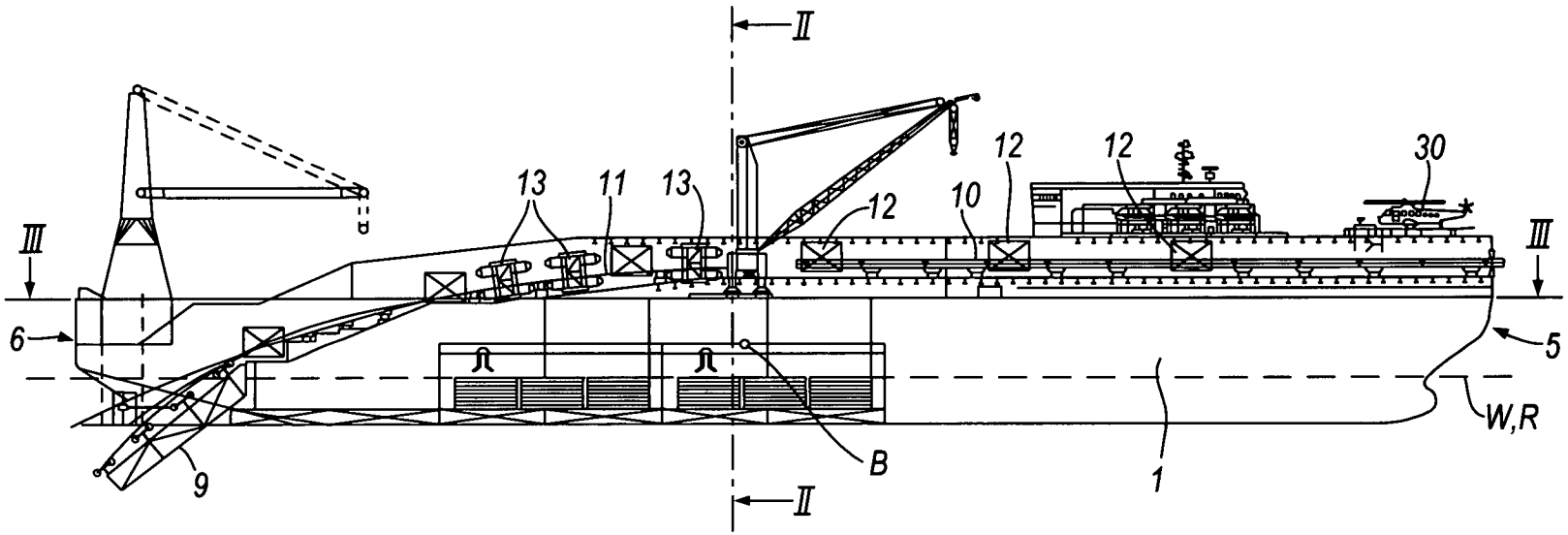
FIG. 1 is a partly sectional side view of a vessel for laying a pipeline.
Figure 2:
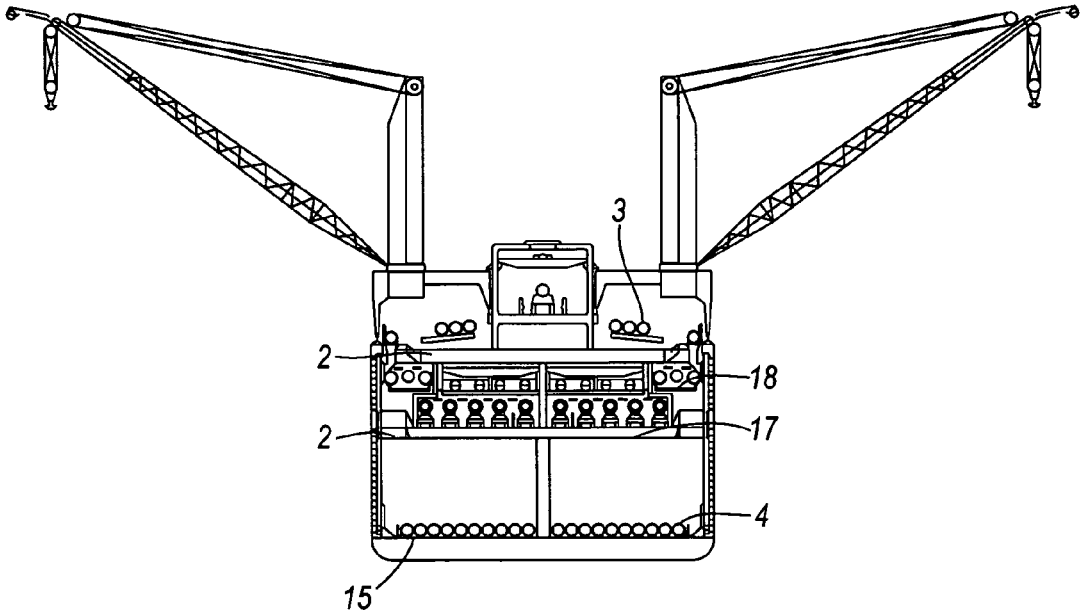
FIG. 2 is a sectional view along the lines II-II of FIG. 1.
Figure 3:
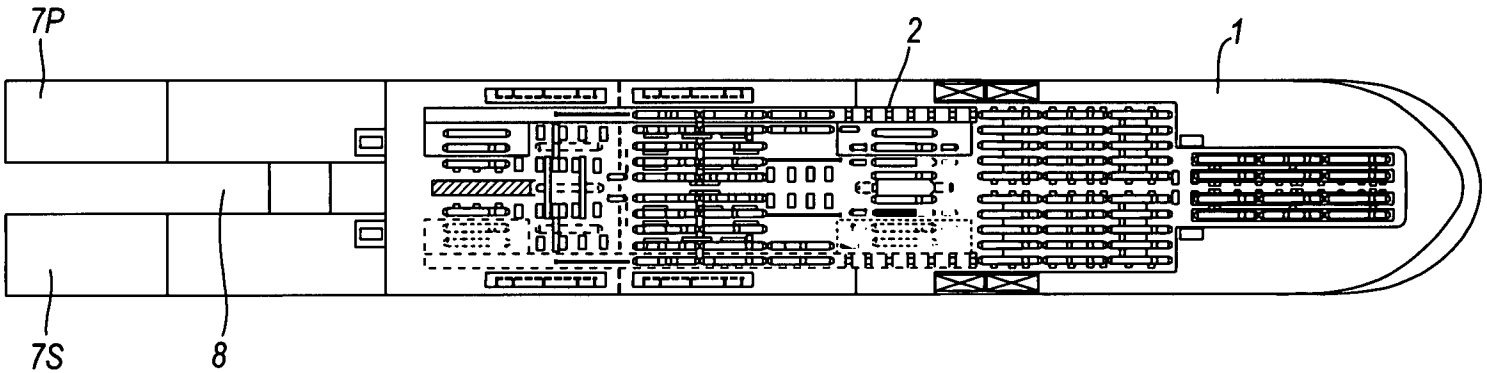
FIG. 3 is a sectional plan view along the lines III-III of FIG. 1, showing only the hull of the vessel.

The vessel shown in FIGS. 1 to 3 generally comprises a vessel hull 1, within which are defined a plurality of prefabricated decks 2 for the prefabrication of jointed pipe sections 3 from individual lengths of pipe 4 and on which cranes and other facilities are provided. The bow 5 of the hull 1 is shown on the right hand side and the stern 6 of the hull 1 is shown on the left hand side, as viewed in FIG. 1.

As can be seen from FIGS. 1 and 3, the vessel hull 1 is of unconventional design at its stern end, having starboard and port end portions 7S and 7P between which an elongate recess 8 is defined. The recess 8 is open at the stern end of the hull 1 and is also open downwardly (into the sea), but it may be closed over the top by a deck. As shown in FIG. 1, but omitted in FIG. 3, an internal ramp 9 is pivotally connected to the hull of the vessel and is disposed in the protected stern area defined by the recess 8.

The barycentre B (centre of gravity) of the vessel is marked in FIG. 1, which also shows the water line W (the level of the sea when the vessel is at its working draught). The rolling axis R (the axis about which the vessel naturally rolls) is coincident with the waterline W.

Along the length of the middle of the vessel a pipe laying path P (firing line) is defined. The path is provided by three ramps: at the upstream end (the right hand end as seen in FIG. 1) of the path, there is a horizontal, straight, fixed ramp 10. Following that there is a curved, fixed, ramp 11 which extends between the fixed ramp 10 and the internal ramp 9, which is the third ramp. Thus the pipe laying path P has an upstream horizontal section, defined by the ramp 10 and leading to a curved section 11 that is of constant, fixed, curvature and which in turn leads to the section defined by the internal ramp 9. The inclination of the ramp 9 relative to the vessel hull 1 can be adjusted and the ramp 9 is also provided with rollers which can be moved in a plane transverse to the pipelaying path P to alter the curvature of the ramp 9. Thus at one extreme (suitable for laying in relatively shallow water), the portion of the pipe laying path defined by the internal ramp 9 may be straight and the downward inclination of the path the same at the downstream end of the internal ramp 9 as at the downstream end of the curved ramp 11; at the other extreme (suitable for laying in relatively deep water) the pipe laying path defined by the internal ramp 9 may be curved downwardly to the same extent as, or even a greater extent than, the curved ramp 11 so that the downward inclination of the pipe laying path P at the downstream end of the internal ramp 9 is substantially greater than the downward inclination of the path at the downstream end of the curved ramp 11. In FIG. 1, the ramp 9 is shown pivoted to a position suitable for increasing the downward inclination of the pipe laying path P.

Welding stations 12 are provided along the fixed ramp 10 for welding new jointed sections of pipe to the end of the pipeline being laid. The active length of the horizontal, straight, portion of the pipelaying path extends from a distance corresponding to one jointed section of pipe upstream of the most upstream welding station 12 (the one furthest to the right in FIG. 1) to the upstream end of the curved ramp 11. The extended length of the horizontal, straight, portion of the pipelaying path extends further to the left (as seen in FIG. 1) to a location below the helicopter 30 shown in FIG. 1. Tensioners 13, of which three are shown in FIG. 1, are provided along the curved ramp 11 for tensioning the pipeline downstream of the tensioners. The precise form of the welding stations and tensioners is not relevant to the present invention and thus may take any known form. It may be noted that in FIG. 1 the tensioners 13 are shown as crawler track tensioners, but it should be understood that they may take other forms.

Downstream of the tensioners 13, the tension in the pipeline will cause it to follow the curvature of the ramps 11 and 9 so that only rollers below the pipeline are required. Upstream of one or more of the tensioners 13, however, where the pipelaying path first becomes curved that tension is hardly present and it may therefore be desirable to provide pressure rollers 31 (not shown in FIG. 1 but shown in FIG. 4) above the pipeline to apply downward pressure onto the pipeline and cause it to follow the path defined by the curved ramp 11. Such pressure rollers 31 can also assist in causing the pipeline to follow the path defined by the curved ramp 11 during abandonment/recovery operations.

As can be seen from FIG. 2 the vessel hull 1 has various decks contained therein. Those decks provide facilities for the assembly of individual lengths of pipe into jointed pipe sections which may, for example, comprise two, three or four individual lengths of pipe. Details of the facilities and their operation are given in our UK patent application entitled "Prefabrication of pipe strings on board of pipe laying vessels" and referred to above. In FIG. 2, there is shown a bottom deck 15, where individual lengths of pipe 4, most commonly of about 12 m length, are stored, intermediate decks 17 and 18 where the individual lengths of pipe are welded together to form the jointed pipe sections 3, each pipe section comprising a plurality of individual lengths of pipe. After prefabrication of the jointed pipe sections 3, the sections are lifted up to the pipe laying path P and welded to the end of the pipeline. As can be seen in FIG. 2, the pipe laying path P is above all the decks on which the prefabrication of the jointed pipe sections 3 is carried out. This high level of the pipe laying path P is a characteristic feature of the described embodiment of the invention.

In use of the vessel to lay a pipeline, the vessel is driven in a forwards direction by its propulsion system and, as is conventional for "S" laying of a pipeline, a considerable forward thrust is maintained, even when the vessel is not moving forwards, to balance the rearward force exerted on the vessel by the tension in the pipeline. The vessel is preferably equipped with a dynamic positioning system to maintain its desired position at all times. The pipeline is passed rearwardly over the vessel along the pipe laying path P with the tensioners 13 controlling the passage of the pipeline. As the end of the pipeline moves along the horizontal fixed ramp 10, new jointed sections of pipe are welded to the end of the pipeline. As the pipeline reaches the curved ramp 11, the pressure rollers above the pipeline cause the pipeline to curve downwardly following the path of the curved ramp 11 and passing through the tensioners 13. The tension in the pipeline increases as it passes through the tensioners 13 reaching full tension after the last tensioner. The pipeline moves away from the vessel hull 1 as it passes from the curved ramp 11 onto the internal ramp 9 and, soon after passing onto the internal ramp 9 enters the water. As can be seen from FIG. 1, the point of entry of the pipeline into the water is within the protected stern area defined by the recess 8 with stern portions 7S and 7P on each side. The pipeline then passes to the end of the internal ramp 9, leaves the internal ramp 9 and passes down to the seabed. Usually, the forward thrust maintained by the vessel will be such that the pipeline is substantially straight and tangential to the end of the curved path defined by the ramp 9 in the region immediately downstream of the internal ramp 9 before then reducing in inclination as it approaches the seabed. In that way any sharp curvature at the end of the internal ramp 9 is avoided.

Figure 4:
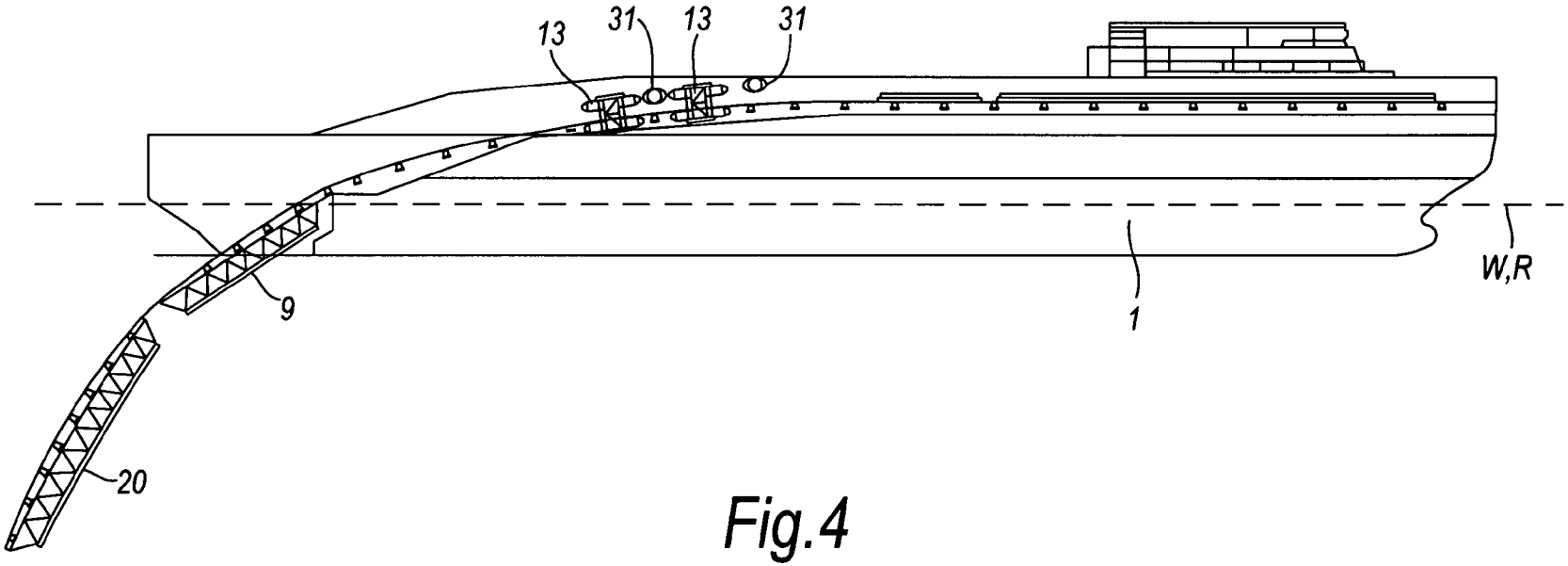
FIG. 4 is a partly sectional side view of the vessel of FIG. 1 showing a further external ramp added to the vessel.

If the vessel is required to operate in deep water, then it may be desirable to add a further ramp and/or stinger downstream of the internal ramp 9 in order to provide further controlled curvature to the pipeline. In this specification, there is no particular distinction made between the use of the terms "ramp" and "stinger" and thus no particular construction of any further ramp is implied by choosing to call it a "ramp" rather than a "stinger". FIG. 4 shows the vessel fitted with an additional ramp 20. It may be noted that FIG. 4 is a more schematic representation of the vessel and does not therefore show all the details shown in FIG. 1. Like the internal ramp 9, the inclination of the additional ramp 20 relative to the internal ramp 9 may be adjustable and the ramp 20 may also have rollers whose positions can be adjusted to alter the curvature of the pipelaying path defined by the ramp 20. In addition to the additional ramp 20, it would be possible to add a further ramp, if desired. It can be seen from FIG. 4 that even with the ramp 20 fitted, the end of the pipelaying path defined by the end of the last ramp is not far beyond the stern of the vessel hull, but is deep underwater and inclined very steeply to the horizontal.

In the description above, dimensions of the vessel and of the pipelaying path are not mentioned. The particular arrangement chosen for any particular vessel will depend on many circumstances, including the envisaged use of the vessel. For a vessel embodying the invention and especially well suited to laying triple lengths of pipe, each of 36 m length (12 m per individual pipe length), a particularly advantageous set of ranges of parameters is as follows:

| | |
|---|---|
| Length of vessel hull 1: | 260 m to 330 m |
| Breadth of vessel hull 1: | 35 m to 45 m |
| Radius of curvature of curved ramp 11: | 300 m to 310 m |
| Depth of internal ramp 9 below waterline when inclination of ramp is at its minimum: | 5 m to 10 m |
| Inclination of pipelaying path P to horizontal at end of internal ramp 9 when inclination of ramp is at its maximum: | 45° to 54° |

-continued

| | |
|---|---|
| Inclination of pipelaying path P to horizontal at end of internal ramp 9 when inclination of internal ramp 9 is at its minimum: | 24° to 30° |
| Inclination of pipelaying path P to horizontal at end of ramp 20 when inclination of ramp is at its maximum: | 70° to 80° |
| Ratio of extended length of straight fixed ramp 10 to the length of the vessel hull 1: | 0.52 |
| Ratio of active length of straight fixed ramp 10 to the length of the vessel hull 1: | 0.46 |
| Ratio of length of horizontal projection of curved ramp 11 to the length of the vessel hull 1: | 0.3 to 0.4 |
| Ratio of length of horizontal projection of internal ramp 9 at minimum inclination to the length of the vessel hull 1: | 0.08 to 0.15 |
| Ratio of the distance d (FIG. 1) of the junction of the straight ramp 10 with the curved ramp 11 from a vertical plane transverse to the vessel and passing through the barycentre of the vessel to the length of the vessel hull 1: | less than 0.05 |
| Distance of pipelaying path P defined by the straight fixed ramp 10 from the rolling axis of the vessel: | 20 m to 25 m |
| Distance of pipelaying path P defined by the straight fixed ramp 10 from the bottom of the vessel hull 1: | 25 m to 35 m |

A vessel of the kind described above with reference to the drawings is able to conduct effective pipe-laying operations with a wide variety of sizes of pipe and in both shallow and deep water, with especially deep laying being possible with smaller diameter pipe. Furthermore the vessel is able to operate in very shallow water, even in harbours. Also, the location of the internal ramp within the protected stern area makes the vessel suitable for operation in the subarctic and arctic zones.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims.

The invention claimed is:

1. A floating monohull vessel for subsea laying of a pipeline, comprising:

a pipelaying path including an upstream portion that is substantially horizontal and at least 10 m above a centre of rolling of the vessel, and towards a first end of the vessel's hull, a downstream portion that is downwardly inclined and, in use, enters water at a location inboard of the first end of the vessel hull;

a plurality of tensioners disposed along the pipelaying path; and welding stations disposed along the upstream portion of the pipelaying path for welding further lengths of pipeline to a pipeline being laid along the pipelaying path.

2. A vessel according to claim 1, in which the vessel hull comprises:

separate portions on opposite sides of the pipelaying path on a waterline and in a region of the first end.

3. A vessel according to claim 2, in which the separate portions define between them on the waterline a recess that is open at the first end of the vessel hull.

4. A vessel according to claim 2, in which the separate portions define between them a recess that is open at a bottom.

5. A vessel according to claim 2, in which the separate portions are joined to one another above the waterline.

6. A vessel according to claim 1, in which the first end of the vessel hull is a stern end.

7. A vessel according to claim 1, in which at least one tensioner is disposed along a portion of the pipelaying path that is inclined downwardly relative to the upstream portion of the pipelaying path.

8. A vessel according to claim 1, in which all the tensioners are disposed along portions of the pipelaying path that are inclined downwardly relative to the upstream portion of the pipelaying path.

9. A vessel according to claim 1, comprising:

one or more pressure rollers disposed along the pipelaying path upstream of the tensioners for pressing the pipeline into a curved configuration.

10. A vessel according to claim 1, comprising:

prefabricating stations on the vessel for welding individual pipe lengths together to form lengths of pipeline, each comprising a plurality of individual pipe lengths.

11. A vessel according to claim 10, in which the prefabricating stations are located on decks below the level of the upstream portion of the pipelaying path.

12. A vessel according to claim 1, in which, in at least one configuration of the vessel, the pipelaying path enters the sea at an angle inclined to the horizontal of more than 20 degrees.

13. A vessel according to claim 1, comprising:

an internal ramp which defines a part of the pipelaying path and which is connected at one, upstream end to the hull of the vessel.

14. A vessel according to claim 13, in which a downstream end of the internal ramp is located in the region of the first end of the vessel hull.

15. A vessel according to claim 13, in which a downstream end of the internal ramp is located inboard of the first end of the vessel hull.

16. A vessel according to claim 13, in which, at a downstream end of the internal ramp, the pipelaying path is more than 5 m below the water line.

17. A vessel according to claim 13, in which a ratio between a length of a horizontal projection of the internal ramp and a length of the hull of the vessel is between 0.05 and 0.20.

18. A vessel according to claim 13, comprising:

an external ramp which defines a part of the pipelaying path and which is connected at one, upstream end to a downstream end of the internal ramp.

19. A vessel according to claim 18, comprising:

a further ramp which defines a part of the pipelaying path and which is connected at an upstream end to the downstream end of the external ramp.

20. A vessel according to claim 1, in which the substantially horizontal upstream portion of the pipelaying path is substantially straight.

21. A vessel according to claim 20, in which a ratio of an extended length of the straight, substantially horizontal, upstream portion of the pipelaying path to a length of the hull of the vessel is between 0.48 and 0.56.

22. A vessel according to claim 1, in which the pipelaying path includes a curved portion extending from the straight, substantially horizontal, upstream portion of the pipelaying path to the downstream portion of the pipelaying path.

23. A vessel according to claim 22, in which a radius of curvature of the curved portion of the pipelaying path is in a range of 270 to 310 m.

24. A vessel according to claim 22, in which the curved portion extends from the straight, substantially horizontal, upstream portion of the pipelaying path to a region where the pipelaying path leaves the vessel hull.

25. A vessel according to claim 24, in which a ratio of a length of the horizontal projection of the curved portion of the pipelaying path to a length of the hull of the vessel is between 0.25 and 0.45.

26. A vessel according to claim 22, in which a junction of the curved portion with the straight, substantially horizontal, upstream portion of the pipelaying path is at a distance d from a vertical plane midway between ends of the hull of the vessel, where a ratio of d to a length of the hull of the vessel is less than 0.1.

27. A floating monohull vessel for subsea laying a pipeline, comprising:

a pipelaying path including a horizontal upstream straight portion and a curved portion defined by a ramp downstream of the straight portion along which a downward inclination of the pipelaying path to the horizontal increases;

at least one tensioner disposed along the pipelaying path, the at least one tensioner being positioned partway along the curved portion; and welding stations disposed along the upstream portion of the pipelaying path for welding lengths of pipe to a pipeline being laid along the pipelaying path.

28. A vessel according to claim 27, comprising:

one or more pressure rollers disposed along the pipelaying path upstream of the tensioner positioned partway along the curved portion of the pipelaying path.

29. A vessel according to claim 27, in which the pipelaying path enters water at a location inboard of an end of the vessel hull.

30. A method of subsea laying a pipeline from a floating monohull vessel, comprising:

guiding the pipeline along a substantially horizontal path at least 10 m above the level of a centre of rolling of the vessel;

welding lengths of pipe to the pipeline at welding stations, disposed along the substantially horizontal path; and guiding the pipeline along a curved path defined by a ramp and into the sea inboard of the vessel.

31. A method according to claim 30, comprising:

increasing a tension in the pipeline as it passes along the curved path.

32. A method according to claim 30, in which the pipeline enters the sea at an angle inclined to the horizontal of more than 20 degrees.

33. The method of subsea laying a pipeline from a floating monohull vessel, according to claim 30, comprising:

welding together, individual pipe lengths at prefabrication stations to form jointed pipe sections.

34. A method according to claim 33, in which each jointed pipe section comprises three individual lengths of pipe.

35. A method of subsea laying of a pipeline from a floating monohull vessel, including a pipelaying path having an upstream portion that is substantially horizontal and at least 10 m above a centre of rolling of the vessel, and towards a first end of a vessel hull, a downstream portion that is downwardly inclined and, in use, enters water at a location inboard of the first end of the vessel hull, and a plurality of tensioners disposed along the pipelaying path, the method comprising:

guiding the pipeline along the substantially horizontal path at least 10 m above the level of the centre of rolling of the vessel;

welding lengths of pipe to the pipeline along the pipelaying path at welding stations disposed along the substantially horizontal path; and guiding the pipeline along a curved path defined by a ramp and into the sea inboard of the vessel.

* * * * *